United States Patent [19]

Kooi

[11] Patent Number: 5,039,455

[45] Date of Patent: Aug. 13, 1991

[54] PROCESS FOR CONTINUOUS EXTRACTION OF PALM OIL OR VEGETABLE EDIBLE OIL

[76] Inventor: Boon-Lam Kooi, 14429 Swallow Rue, Pierrefonds, Quebec, Canada, H9H 1S6

[21] Appl. No.: 387,585

[22] Filed: Jul. 31, 1989

[51] Int. Cl.[5] ..... C11B 1/00

[52] U.S. Cl. ..... 260/412.2

[58] Field of Search ..... 260/412.2

[56] References Cited

FOREIGN PATENT DOCUMENTS 1209675 10/1970 United Kingdom ..... 260/412.2

*Primary Examiner*—Jose G. Dees

*Assistant Examiner*—Deborah D. Carr

[57] ABSTRACT

Improvement in the conventional process of recovering palm oil. This process is made continuous by the steps of continuously introducing fresh fruit bunches in a receiving bin; while the fresh fruit bunches are in the receiving bin, treating the fruit bunches with steam to deactivate any enzyme responsible for the formation of free fatty acid in the fruit bunches; continuously removing fresh fruit bunches treated in the receiving bin, separating the loose fruitlets and continuously subjecting same to a combined sterilizing and stripping operation to detach fruitlets from the fruit bunches; continuously feeding the fruitlets, each consisting of a nut surrounded by a pericarp, to a pressurized digester; continuously blowing the digested fruit to a blow tank; and continuously extracting oil by pressing the digested fruit mass.

14 Claims, 2 Drawing Sheets

PROCESS FOR CONTINUOUS EXTRACTION OF PALM OIL OR VEGETABLE EDIBLE OIL

BACKGROUND OF INVENTION (a) Field of the Invention

The present invention relates to a process of producing palm oil or the like. More particularly, the invention is directed to a continuous milling process for extracting palm oil, or similar vegetable edible oil, and in particular relates to the continuous sterilization, stripping, and pressurized digestion of fruit bunches during the palm oil extraction stages.

(b) Description of Prior Art

Oil Palm (Elaeis Guineensis Jacq.), which originated in Africa, exists in wild, semi-wild and cultivated land areas of the equatorial tropics of Africa, South East Asia and South America. At the present time, the oil palm is cultivated over a wide range of tropical climatic conditions and soil types.

For optimum yield, a rain fall of 80 inches or more per year is required, and should be uniformly distributed throughout the year. In addition, the minimum temperature should be within a range of 22° C. to 24° C. and the maximum temperature should be within the range of 29° C. to 32° C. with a daily sunshine exceeding 5 hours per day.

Under the above conditions, it is possible to produce 10 to 12 tons of bunches per acre per year, resulting in a higher yield of palm oil. At the plantation nursery, the seeds (nuts) are allowed to germinate and to grow into young plants before the latter are transplanted into a field. The rate of growth is 1 to 2 feet per year with a life expectancy of 100 years. It is possible to cut the plants and replant them after 25 years as they become taller. As the palm grows, new leaves (fronds) are produced and increase to 30 to 40 in 5 or 6 years, after which the new growth declines to 20–25 per annum.

In the axle of each leaf is a bud which will develop into male and female inflorescences. Male and female flowers are borne in the same palm but on separate inflorescences. The male inflorescence may contain 700 to 1200 flowers, however the female inflorescence may contain several thousands flowers. After pollination the female inflorescence develops into a fruit bunch and it takes 5½ to 6 months to develop into a ripe fruit bunch.

Most of the oil in the fruit is produced during the last two to four weeks before it reaches full ripeness. The individual fruits in a bunch reach full ripeness over a period of about 2 weeks, with the most exposed fruits ripening first. A mature palm tree can produce 5–10 bunches/year each containing 1000–2000 packed fruits and sometimes more than 2000 fruits in exceptional cases.

Among the plants producing edible oil, the oil palm yields the most oil per hectare. With the recent introduction of African weevil Eloeidobiuss Kamerancius in 1981, especially in Malaysia, the yield has increased greatly. This insect is a very efficient pollinator for oil palm flower and results in bunches with fruitlets in many layers. A typical palm fruit is a drupe, oval in shape, and contains a kernel, which is the true seed. The kernel is surrounded by the fruit wall (pericarp) made up of the hard shell (endocarp), oil bearing tissues (mesocarp) and the skin (exocarp). The palm oil is extracted from the mesocarp of the fruit wall, while the kernel oil is derived from the seed. For the purpose of the present invention, which is concerned with a milling process, the nut (seed) will be defined as a shell with the enclosed seed after the removal of the mesocarp. The pericarp will be understood to mean the mesocarp and exocarp combined. The palm fruit can be classified into three generic types namely Dura, Pisifera and Tenera. The Dura fruit is characterized by its thick shell while the Pisifera fruit has no shell. The hybrid between the two, the Tenera fruit, has a thin shell. , The fresh fruit contains enzymes capable of splitting the triglyceride contained in palm oil, into free fatty acid. When the bunch is cut, the enzymes start to catalyse and break down the oil into free fatty acid and partial glyceride. When the enzyme is in contact with the oil, the reaction is rapid. Thus, when the fruit is damaged, the oil released will be in contact with the enzyme and accordingly the free fatty acid will increase.

Palm fruits have to be harvested and transported to the milling factory before the palm oil can be extracted. The theoretical amount of oil contained in the fruit is fixed at the moment when the fruit bunch is cut. The amount of oil contained in the fruit will deteriorate due to free fatty acid increase through bruising and damaging of the fruit in the course of harvesting and transportation to the mill and through aging before the fruits are processed. It is believed that the free fatty acid increase is due to the action of enzymatic endegenous lipase in ripe mesocarp.

Individual fruits do not ripen at the same time and the ripening process is repeated in period of 15 days or less. When the fruit is ripe, it is easily detached to become a loose fruit. For the maximum oil production in the fruits, the fruits have to be cut at the optimum ripeness and cycle time.

Normally, during the final week of the ripening, the oil production will increase. Once the fruit is cut or detached, the oil production stops. If the fruit is left overripe, the fruit will be detached from the bunches and fall to the ground resulting in more loose fruits with the result that the free fatty acid will increase in loose fruits because of bruising. The criterion used to harvest the bunch is based on the count of number of loose fruit fallen on the ground. There is a compromise between the increase of acceptable free fatty acid due to the overripening and the maximum oil produced in the bunches. Optimum harvesting cycle time and optimum minimum ripeness standard are established to ensure a maximum oil content and a minimum acceptable level of free fatty acid in fruit bunches.

By the time the fresh fruit bunch arrives at the factory, it should be processed right away without further delay to prevent any increase in free fatty acid. The oil content in the palm fruit is fixed and the purpose of milling is to ensure a maximum oil extraction while minimizing the losses.

The palm oil milling process is a very unsteady process which depends on a lot of human factors during the harvesting and transportation phases, and also on factors such as types of crops, harvesting cycle, peak crop season, etc.

The prior art process for the extraction of palm oil uses the technology developed some 30 years ago in Africa. The palm oil milling process known in the art comprises the major steps of: preparing fresh fruit bunches (FFB), digestion, oil extraction, oil clarification, sludge separation and kernel separation. There are two main products derived from the palm oil milling process namely palm oil and kernels. In the step involving the preparation of fresh fruit bunches, the process used is batch wise and involves a lot of manual handling for operating equipments such as cages, valves, etc., thereby causing potential safety hazard, inefficient operation resulting in a lot of wastage, poor quality of oil and pollution problems, etc.

For the oil extraction stages, there are several different extraction methods which are known in the art. They are generally classified as the wet process, using a wash liquid to free the oil in palm fruit and the dry process such as one involving the use of a batch type hydraulic press, a semi-continuous type hydraulic press and a continuous type screw press, etc. Each method has its advantages and disadvantages. The wet process ensures that there is no nut breakage but results in the loss of large cell debris in the oil. Thus, the continuous screw press gives a high throughput, and operates at comparatively low energy cost, but tends to result in a high amount of nut breakage when the operating conditions are not ideal.

It will also be realized that the preparation of the fresh fruit bunches is an important step of the whole palm oil milling process, and that it has a great effect on the subsequent operations with regards to the yield and the quality of the product.

As understood from the prior art, the major components of palm fruits are the oil bearing tissue, called the mesocarp and the nut which contains the kernel. In the palm oil milling process, the two major products obtained include the crude palm oil and the kernel. The crude palm oil is extracted from the palm fruit using one of the extraction methods described above while the kernel is obtained by separation from the nut by a cracking process. Other by-products such as fibers, shells and empty bunches are also produced.

For the purpose of palm oil milling, as much as possible of the oil content present in the palm fruit must be extracted, while at the same time minimizing all oil losses. As presently practiced in the art, when the lorry of fresh fruit bunches arrives at the mill, the lorry load is emptied and fresh fruit bunch is piled up in the yard and loading ramp waiting to be processed. Together with the fresh fruit bunches there are loose fruits lying together with the bunches.

The quantity of loose fruits, normally amounts to 10%–20% of the bunches and depends on the harvesting conditions. Most of the loose fruits are damaged and contaminated with sand and dirt, and when in contact with the ground they form an ideal situation for mold growth and for causing an increase of free fatty acid due to enzymatic action. The loose fruits are not separated and they are processed together with the bunches causing oil lose to the bunch stalk through contact and also contaminating the bunches with sand and dirt. The bunches are not processed right away, causing further free fatty acid increase due to mold growth and aging No bunches should normally be allowed to ripen optimally for more than 3½ days. If the bunches are harvested more than 3½ days than the optimum and because of a further delay in processing the fresh fruit bunches at the mill, the free fatty acid increase will be aggravated.

From the loading ramp, the fresh fruit bunches are loaded in cages and are transported by operators, normally by rail to the sterilizer. The cages are perforated to allow steam to penetrate into the bunches. The cages are mostly constructed of iron. Due to the contaminating action of vapor in the sterilization vessel, the cages are corroded The corrosion of the cages contribute for a major part to the iron contamination in palm oil. Iron is an oxidant and it accelerates the process of oxidation of palm oil, causing bleachability problem, etc. The cages loaded with fresh fruit bunches are sterilized in the sterilization vessel. The cages generally hold 2.5 tons to 3 tons of fresh fruit bunches.

It is believed that the sterilization results in: (i) deactivation of the oil-splitting enzymes in order to prevent an increase in free fatty acid; (ii) loosening the fruit in the bunch to facilitate the stripping process; (iii) softening the fruit pulp for easier further treatment (digestion) of the fruit; (iv) heating and partially dehydrating the nuts in order that the nuts may be cracked more readily; (v) coagulation of protein in the oil bearing cells to prevent formation of colloidal complexes, thus facilitating the separation/clarification of the oil in the oil recovery process; (vi) hydrolysis/decomposition of mucilaginous material which will facilitates the oil clarification process.

Great care is taken during sterilization to exclude air which interferes with the sterilization efficiency and may cause oxidation of the oil.

The sterilization is normally carried out in a horizontal vessel holding between three (3) to nine (9) cages of fresh fruit bunches. Saturated steam at 40 psig is used as the heating medium. The sterilization is a batch process which consists of the following sequence of operations: heating, venting, deaeration, condensate removal. Single, double or triple peak sterilization is normally practiced.

The total cycle time may vary from 70 to 90 minutes. The physical design of the sterilization vessel entry and outlet.

After sterilization, the cages loaded with sterilized fresh fruit bunches are manually removed from the sterilizer, they are then lifted by means of an overhead crane and emptied into a stripper. The purpose of stripping is to separate the fruitlets and calyx leaves from the branch stalks. The type of stripping machine generally used is a rotating drum made of bars spaced just enough to permit the escape of the fruit and of the calyx leaves. As the drum rotates, the bunches inside the cage are lifted up then dropped back again. Consequently, by this action, the fruits are knocked out of the bunch, while the empty stripped bunches are discharged for disposal.

It will be realized that the prior art process of sterilization and stripping is carried out in a batch wise manner. There are numerous shortcomings and disadvantages. In the sterilization process described above, because the bunches are stacked in cages, steam does not penetrate uniformly and the bunches in the middle of the cages tend to receive less steam treatment. Other disadvantages include the following.

Because of the batch operations, the air in the vessel must be expelled before steam can penetrate , through the bunches. This is normally done in the prior art by steaming and venting the steam, thus resulting in a lot of steam wastage.

The fruit bunches which are in the cages are of different sizes, which means that the time required for the bunches to reach a certain temperature normally depends on the individual bunches. Owing to the fact that the bunches are loaded in cages and the difficulty for steam to penetrate to the center of bunches, it is quite possible that the bunches in the center of the cage will not reach the required temperature.

In addition, due to rigorous steaming and exhaust operations, it is quite possible that there will be a loss of oil from the bunch, due to the fact that the oil is carried away in the steam condensate and exhaust. The condensate which is acidic is responsible for the corrosion of the cages, while the iron contaminates the oil during the milling process.

In the prior art sterilization process, the cycle is fixed and is very seldomly changed. Owing to the different type of crop and different conditions of ripeness, the uneven steaming of the bunches and the fixed time cycle employed in the sterilization often results in hard bunches which are not conducive to the production of palm oil. Also it will affect the subsequent stripping operation and nut cracking. In order to ensure good nut cracking in the kernel plant, the nut has to be heated and conditioned at the later stage.

On the other hand, the sterilization at a fixed temperature may lead to an over sterilization of some overripe bunches. As a result, the kernel tends to become discolored. The tendency of the kernel to become discolored is often used as a criterion to determine the maximum of the sterilization temperature.

The batch sterilization process often produces a boiler upset when the demand of steam is great especially during the steaming cycle. Even though the problems can be overcome by better energy management, the inherent nature of the boiler instability is always here.

In the prior art process, the stripper operates in a batchwise manner. The stripping operation is dependent on the frequency at which the operator dumps the sterilized cages of fruit bunches. The feeding of the sterilized fruit bunches to the stripper is nearly always uneven (over dumping), and the fruit bunches are piled up. This results in oil losses through its absorption in the stalks and the calyx leaves. The calyx fragments have an effect of reducing the oil loss in the cake that is ejected from the press.

Due to the deficiency in the operation of the stripper of the prior art, the latter will produce bad bunches. The stripability also depends on the good performance during the step of sterilization. The presently known stripper has a feeder which is sloped toward the discharge end which will aggravate the piling up of fruit bunches. The loose fruits which are detached from the bunch during the reception at the beginning of the process are stripped together with the rest of the bunch, and it is therefore a waste operation to pass them together with the bunches.

Finally, the present prior art process poses a safety hazard during the lifting of the cages of sterilized fruit bunches prior to the dumping thereof into the stripper.

According to the process of the prior art, after the fruitlets have been stripped, they are sent to the digester. The digester is a cylindrical vessel fitted with vertical rotating shaft carrying a number of stirring arms. The purpose of the digestion is to rupture the oil bearing cells so that the palm oil can be released during the pressing stage. Typical retention time is 30 minutes and the temperature is maintained at 95 to 100 degrees C. The temperature is maintained by jacketed steam, but sometimes live steam is added.

In principle, during the digestion process, two actions occur. Firstly, due to the weakening of cell membrane there is an intensive release of virgin crude oil corresponding to 15%-20% of the weight of the bunches, drawn off through the perforation of the digester and secondly, there is a rupture of oil cell due to stirring action on the fruit mass. In order to ensure complete digestion sufficient retention time is maintained. The digested mass of palm fruit will then be discharged from the digester to the screw press for oil extraction.

The oil cells are bonded to each other and the skeleton of fibers runs lengthwise by inter-cellular bonding. The bonding is pectic in nature. The amount of pectin increases during ripening and is soluble in very hot water but not in cold water. When the bond dissolves, it disintegrates into oil cells and fibrous materials.

The wall of the oil cell is extremely elastic and there is very little difference between the pressure inside and outside the cell. The collapse of the cell wall requires extremely high pressure, even though, it is not probable that all the cells will be ruptured simultaneously. During the process of sterilization, the effect of steam will help the cell wall to collapse (not rupture) and it is believed that this it is achieved partly by hydrolysis and partly by coagulation.

In the prior art process, the crude oil drained from the digester contains more non-oil solids and cell debris. This oil is manually mixed with the oil coming from the press before going to the clarification process. The cell debris consist of broken unruptured oil cells, which are fairly difficult to recover in the clarification stage. The cell debris will be carried away with the sludge and constitute a source of oil loss. This oil loss represents close to 1% of the production of oil.

In the prior art process, because the oil drained from the digester contains more fibrous materials (non-oil solids), this loss will result in lower percentage of fiber in the press cake produced in the press, which will lead to an extra nut breakage in the press and higher oil loss in the pressed fiber. A certain nuts/pericarp ratio of about 35-40/65-60 should be maintained for proper operations in the press.

In prior art process, because the sterilization does not give sufficient treatment when processing different type of crops and their ripeness, and because fixed time cycle is employed as the result, the time required for a proper digestion needs to be optimized.

Because the prior art is concerned with a batch process during sterilization and stripping, the operation of the digester tends to be easily upset if there is a break in the process during the sterilization step. The last stage of the digester is never operated at full level, thus reducing the retention time of the fruitlets.

It is an object of the present invention to provide an improved palm oil milling process which eliminates the cages and the handling operations during the sterilization and stripping steps.

It is a further object of the present invention to provide an improved palm oil milling process whereby fresh fruit bunches are processed without delay on reception in the receiving bin while pre-steaming eliminates the chances of an increase in free fatty acid while the fresh fruit bunches laying on the ground are waiting to be processed.

It is another object of the present invention to provide an improved palm oil milling process wherein the conventional batch wise process is converted to a continuous process thus rendering the automation of the entire plant possible.

It is a further object of the present invention to provide an improved palm oil milling process by combining the sterilization and stripping into a single continuous operation thus reducing the time cycle required during a batch-wise conventional sterilization process and optimizing the sterilization/stripping operation in an energy efficiency manner.

It is a further object of the present invention to eliminate the instability of the boiler operations, and to reduce air pollution caused by black smoke during boiler upset by continuously supplying steam to the sterilizer/-stripper.

It is a further object of the present invention to provide an improved palm oil milling process which minimizes the loss of oil experienced in the sterilization process of the prior art and improves the bleachability of the oil by eliminating the cages responsible for iron contamination due to rusting.

It is a further object of the present invention to provide an improved palm oil milling process to increase the oil extraction efficiency by treating the stripped fruitlets in a pressurized digester which facilitates the breakage of oil cells and improves the efficiency of oil extraction during the pressing stages, and oil quality and minimizes nut breakage.

It is another object of the invention, to provide a process wherein, upon reception, the fresh fruit bunches will be conveyed to a receiving bin where presteaming will be carried out at the minimum temperature of 55° C. in order to deactivate the enzymatic reaction and to stop the increase of free fatty acids prior to full sterilization/stripping stage.

It is another object of the present invention to provide a continuous process which can be adapted for the conversion of existing palm oil milling processes which rely on a batch process including fresh fruit bunches preparation and screw press for extracting the oil .

It is another object of the present invention to separate the loose fruits for prewash and mild steam treatment in order to eliminate sand and dirt and also to prevent any mold growth in loose fruits.

It is another object of the present invention to provide a process wherein stripped fruitlets may be continuously conveyed by means of an elevator to a surge bin and to regulate the flow of fruitlets to the digester on a continuous basis.

It is yet another object of the preset invention, to minimize oil loss through cell debris in the sludge by providing pressurized digestion which will ensure maximum cell rupture in the digested fruitlets before the pressing stage.

SUMMARY OF INVENTION

The invention relates to an improved process for producing palm oil or vegetable edible oil from fresh fruit bunches of various generic types such as Dura, Tenera and Pisifera and its cross-breeds. This invention can be adapted for the conversion of existing palm oil mills which employ a batch process.

This process is made continuous by the steps of:

a. continuously introducing the fresh fruit bunches in a receiving bin;
b. while the fresh fruit bunches are in the receiving bin, treating the fruit bunches responsible for the formation of free fatty acid in the fruit bunches;
c. continuously removing fresh fruit bunches treated as in step b. separating the loose fruitlets and continuously subjecting same to a combined sterilizing and stripping operation to detach fruitlets from the fruit bunches;
d. continuously feeding the fruitlets, each consisting of a nut surrounded by a pericarp, to a pressurized digester;
e. continuously blowing the digested fruit to a blow tank; and
f. continuously extracting oil by pressing the digested fruit mass.

In accordance with a preferred embodiment of the invention, the deactivation of the enzymes is carried out by heating the fruit bunches at a temperature of at least 55° C.

The presteaming of the fresh fruit bunches is preferably carried out by introducing steam in the receiving bin. The presteaming lasts about 5 to about 60 minutes and the temperature in the receiving bin is maintained at between about 60° C. to 100° C.

In accordance with another embodiment of the invention after sterilizing and stripping in step c. the fruitlets are continuously conveyed to a surge bin previously to being received by the steam pressurized digester, the surge bin providing a retention time so as to control and regulate the flow of fruitlets to the digester.

The sterilizing and stripping operation is preferably carried out in a combined sterilizer stripper in which steam is continuously admitted, the sterilizing and stripping operation lasts between about 20 to 150 minutes and the temperature is maintained at between 60° C. to 150° C.

This is carried out by continuously adding saturated steam while the fresh fruit bunches are being stripped. The fruit bunches are fed from the receiving bin to one end of the combined sterilizer stripper. The drum should be sufficiently long to ensure that the fruitlets will be completely stripped when the bunches reach the other end of the drum. Saturated steam is provided to soften and loosen the fruitlets and facilitating the stripping operation.

In accordance with another preferred embodiment of the invention, loose fruitlets detached from the fruit bunches are separated, prewashed, then they are subjected to a mild steam treatment to merely soften the fruitlets and to render them easy to digest. After that, the fruitlets are directly transferred to the surge bin.

In accordance with another embodiment of the invention, the empty fruit bunches remaining from the sterilizing and stripping operation are transferred to a beater where further stripping of any fruit remaining attached to the empty fruit bunches takes place, the stripped fruits obtained in the beater are then conveyed to the surge bin, and the substantially empty fruit bunches are sent to a disposal unit.

The treatment in the pressurized digester preferably lasts about 20 to 50 minutes and the temperature is preferably maintained in a range between about 90° C. and about 150° C. At the end of digestion, the fruit mass will be blown under pressure from the digester to the blow tank. Oil cells will be ruptured due to depressurization in the course of blowing from the digester. The heat evolved in the blow tank is preferably recovered in a manner known to those skilled in the art.

In accordance with another preferred embodiment of the invention, the digested pericarps and nuts from the digestion stage are fed to a first stage press operating under low pressure to give a crude oil containing a lesser amount of non-oil solids, the pressed pericarps and nuts discharged from that press are fed to a second stage press operating at higher pressure to give a crude oil containing a higher amount of non-oil solids. The crude oil drained from the digester is combined with the crude oil from the second stage press for clarification. The crude oil from the first stage press is clarified separately.

BRIEF DESCRIPTION OF THE DRAWINGS

Having thus generally described the invention, reference will be had to the accompanying drawings, illustrating a preferred embodiment thereof, in which.

Referring to FIGS. 1 and 1A, it will be seen that fresh fruit bunches, hereafter referred to as FFB received by conventional transportation systems from plantations are conveyed to receiving bin 1 as shown by arrow 3. Once inside the receiving bin 1, the FFB are presteamed by introducing saturated steam as shown by arrow 5. This presteaming operation is intended to deactivate the enzymes present in the FFB so as to prevent the formation of free fatty acids in the FFB. It is indeed well known to those skilled in the art that the presence of free fatty acids in the oil is quite damageable. The minimum temperature during presteaming is about 55° C. and in practice, the temperature is maintained at between 60° C. and 100° C. Presteaming should last about 5 to 60 minutes. From receiving bin 1, the FFB are fed to continuous combined sterilizer/stripper device 7. Before feeding the FFB to the combined sterilizer/stripper 7, the loose fruitlets, already detached from the bunches are separated at 9, and prewashed in 97 and then conveyed at 11 to loose fruit mild treatment stage 13. There, a mild steam is introduced at 15, in order to soften the fruitlets thereby rendering them easy to be digested. The mild steam treatment lasts between 5 and 60 minutes and is carried out at a temperature of 60° C. to 100° C. After the loose fruit treatment stage 13, the loose fruits are conveyed to the surge bin 17, which provides for a retention time so as to control and regulate the flow of fruitlets to the digester 19 via pressure seal 18. While the FFB are in the sterilizer/stripper 7, saturated steam is continuously admitted at 21. During their stay in the sterilizer/stripper 7, the FFB should be kept at a temperature between 60° C.–150° C. and should reside therein for about 20 to 150 minutes. The FFB enters at one end of the stripper sterilizer 7 as shown by arrow 23 where they are taken over by a rotating device provided with rotating arms arranged in helical manner and which provide a breaking action. While the FFB travel through the sterilizer/stripper 7, the beating action together with the steam penetration will cause the fruitlets to be detached from the bunches and to be discharged through openings provided in the sterilizer/stripper from which they are conveyed to the surge bin 17.

Figure 1:
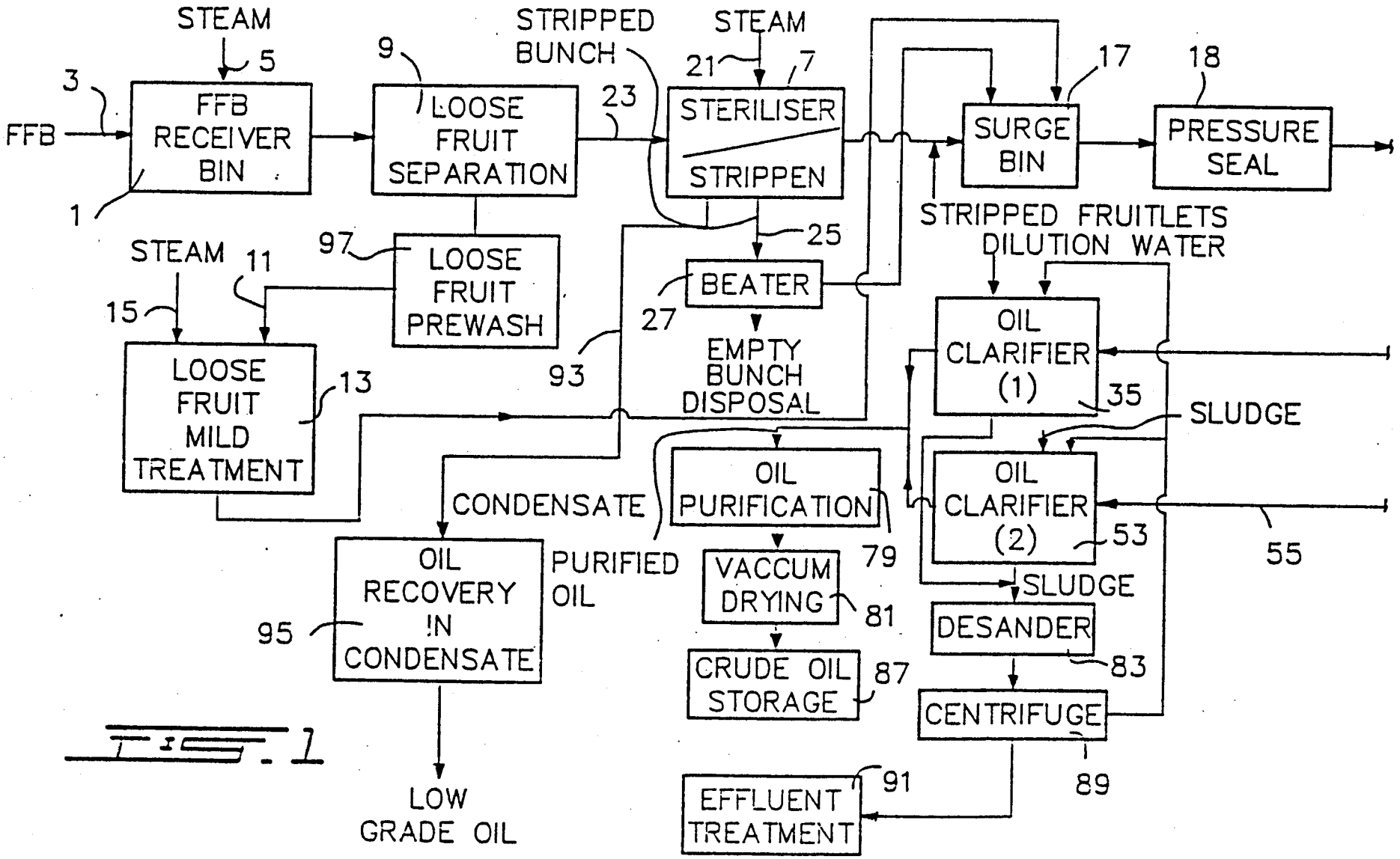
FIGS. 1 and 1A are a process flow chart illustrating the combined sterilization stripping and digestion in the palm oil or edible vegetable oil milling process according to the invention.
Figure 1A:
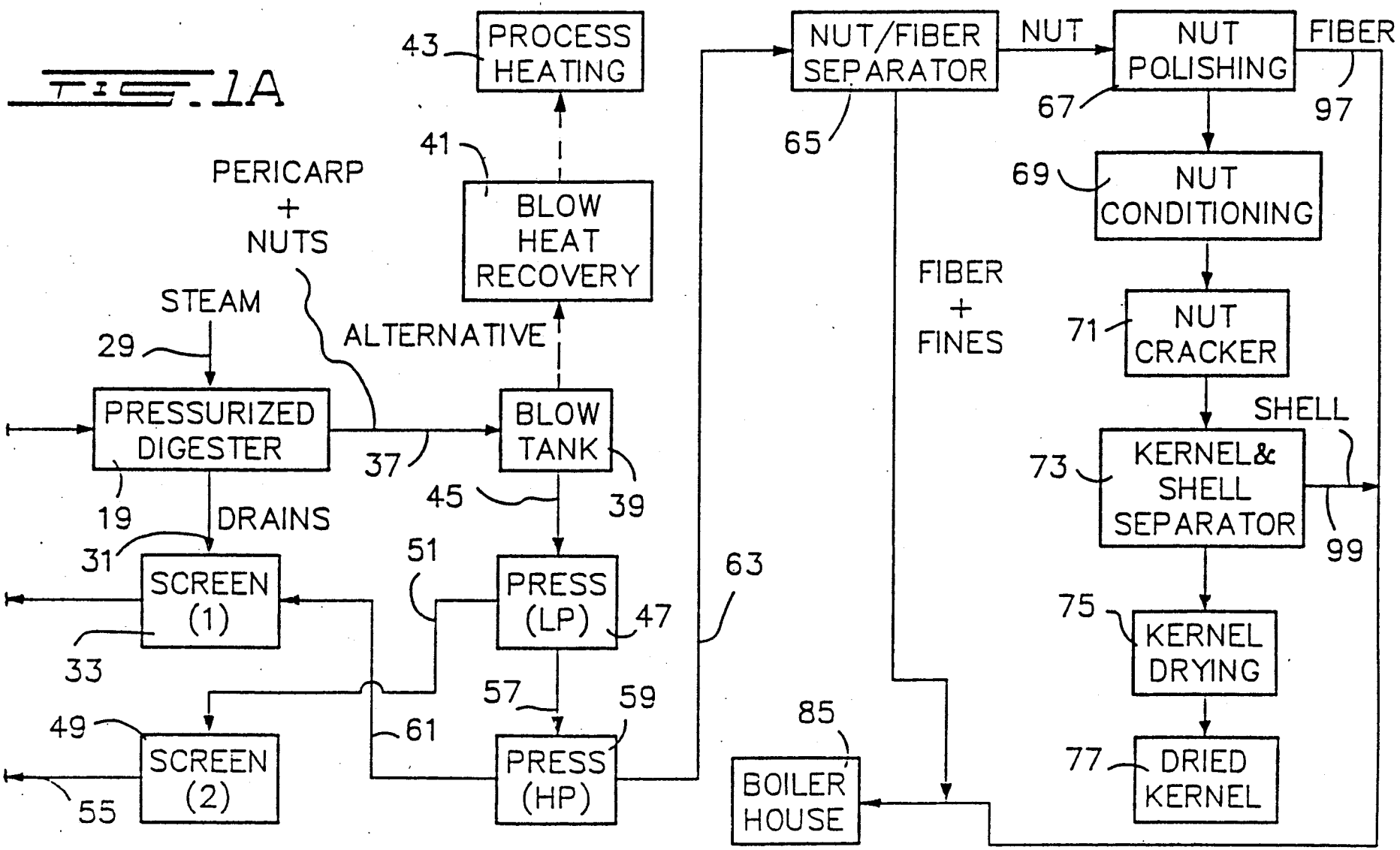

The sterilizer/stripper 7 is sufficiently long so that by the time the FFB reaches the outlet end of the sterilizer/stripper 7 substantially all fruitlets will be stripped or detached from the bunch. The empty bunches are discharged at 25 when they reach the outlet end of the sterilizer/stripper 7 and are conveyed into a beater 27. The beater 27 is intended to further strip any fruit that may remain attached to the empty bunch after which the fruits detached by the beater will be conveyed to the surge bin 17. The condensate drain from the sterilizer/stripper 7 contains palm oil which would be preferably recovered in oil recovery unit 95.

Surge bin 17 provides a retention time so as to control and regulate the flow of fruitlets to the digester 19.

The digester 19 is a pressurized vessel. The temperature is maintained at between 90° C. and 150° C. and the fruitlets are allowed to stay therein for about 20 to 50 minutes. The fruitlets are continuously fed into the digester, through a pressure seal device 18 such as rotary valve from surge bin 17. Any virgin oil which is released from the mass of fruitlets in the digester is drained at 31 to screen 33 from which it will be sent to oil clarifier 35 for clarification. This oil contains high non-oil solid content. Heating in the digester can be achieved by jacketed heating or by direct steam heating as shown in 29. It may also be required to provide an agitator for mild agitation.

The mass which has been treated in the digester and which consists of a mixture of pericarp and nuts is blown under pressure to an atmospheric blow tank 39 through a blow line 37. The force of defibration, due to the depressurization during the digester blowing will cause the oil cells present in the fruitlets to be ruptured. The ruptured oil cells will facilitate the extraction of the oil in the press operation. Under normal conditions, the higher the temperature of the digested fruits, the more elastic the nut will be which will avoid nut breakage in the press. The theory behind the pressurized digestion is that it will facilitate the rupture of the oil cells when the digested fruitlets are blown to an atmospheric blow tank. Depressurization takes place and the mechanical shear force will facilitate the rupture of the oil cell.

Provisions are made to recover the heat released in the blow tank by the blow heat recovery unit 41. This heat will be used in known manner for heating purposes at 43. From the blow tank, the digested mass of pericarps and nuts is fed via 45 to a first stage of pressing 47 which is operated under low pressure.

The press 47 consists, in known manner, of two rotating screws operating in opposite directions where crude oil containing a lesser amount of non-oil solids is sent to screen 49 via 51. From screen 49 the oil is sent to separate oil clarifier 53 via 55. The pressed fibers and nuts are discharged from press 47 at 57 and are fed to the second stage of pressing at 59 which is operated at a higher pressure. The crude oil extracted from this press 59 contains more non-oil solids, which will be combined with the crude oil drained from the digester 19 in screen 33 before sending it to separate clarifier 35.

The pressed fibers and nuts remaining from the pressing operation 59 are conveyed via 63 to a nut/fiber separator 65. The nut/fiber separator 65 may consist, as is well known to those skilled in the art, of a so-called depericarper and a cycloine for separating nuts, fibers and fines. The fibers and fines can be used as fuel in the boiler house 85.

The nuts separated from nut/fiber separator 65 are further polished in nut polishing stage 67 in order to knock down any remaining fiber 97 which will be sent also to boiler house 85. From thereon, the nuts go through a nut conditioning stage 69 which may be further heated or cooled in order to be cracked after being sent to a nut cracker 72. In the nut cracker 71, there are produced a kernel and a shell which are further separated at 73 using either a hydrocyclone or a clay bath. The kernels are then dried at 75 and stored at 77 and the shells 99 are conveyed to a boiler 85 as a fuel.

Oil clarifiers 35 and 53 operate under different conditions. The crude oil in 35 has more non-oil solids than the crude oil in clarifier 53. The purified oil from clarifiers 35 and 53 are combined and sent to oil purification stage 79 wherein foreign particles are removed by centrifugation. The oil is then vacuum dried in vacuum drying device 81 to achieve a certain moisture content in the final product before being stored in 87. The sludge produced in oil clarifiers 35 and 53 is combined and forwarded to desander 83 for the purpose of removing any sand which might adhere to the sludge. The sand free sludge is then centrifuged in the oil centrifugal stage 89 to recover any oil loss in the sludge, which oil is sent back to the oil clarifiers 35 or 53 and the sludge is sent to an effluent treatment plant 91.

The present invention is not restricted to the milling of fruit of oil palm (Elaeis Guineensis Jacq.) and it is equally applicable to the milling of fruit of oil palm which produces cross-breed as hybrid.

The improvement may also be practiced in connection with the milling of other vegetable edible oil fruits.

The present invention has many advantages over the prior art process of palm oil milling. For example, the continuous combined sterilizer/stripper eliminates the cages thus rendering the process more safe to operate which improves the operating efficiency. It will ensure uniform steaming and equal sterilizing treatment of all fresh fruit bunches and better steam penetration to the center of the bunch stalks. The time of sterilizing and stripping will be reduced, because these actions are combined in single operations.

The process according to the invention enables to eliminate the instability of the boiler operation and ensures a smooth supply of steam to the operation of sterilization. Additionally, it reduces air pollution problems by eliminating the black smoke produced during the upset of the boiler steam supply when a peak demand is called for by the sterilizer as in the prior art system.

The system according to the invention eliminates the uneven feeding of fresh fruit bunches to the stripper as practiced in the prior art by providing a smooth feeding of the bunches, thereby eliminating the pile up of fresh fruit bunches in the stripper as practiced in the prior art process, and reducing the oil loss to the bunch stalks.

It also appears that no bunch as green as it may be, will resist the sterilization/stripping step according to the invention, thus eliminating bunches which are not completely stripped as experienced in the prior art process.

In the process according to the present invention, there is a good and uniform heat penetration to the bunches during the combined sterilization/ stripping operation. Heat can penetrate to the point of attachment of the fruits to the stalk to bring about hydrolysis at these points. There are also physio-chemical changes that take place at these points which will help the fruits to be detached from the prior art process.

In the present invention where a treatment is carried out with a combined sterilizer/stripper, sufficient sterilization ensures good nut conditioning, which will help the nut to be loosened from the shells, and the kernel to be shrunk, thereby avoiding nut breakage in the pressing operation and also improving subsequent nut cracking operations. With the process according to the invention, there is no need for scheduling problems during the sterilization as practiced batch-wise in the prior art, thereby also eliminating operations such as single, double or triple peak, which will be easier for the operator. The invention easily leads to full automation and better control of the process for a maximum production rather than the manual operations as practiced in prior art batch process. Finally since the continuous sterilization and stripping process ensures a complete removal of air, there is an efficient transfer of heat during the sterilization process.

The pressurized digestion system ensures uniform heat treatment to the fruitlets. There is no local overheating likely to be experienced as in the prior art process. As a result, good bleachability of crude oil is insured.

In principle, the screw press operation is to extract the maximum amount of oil in the digested fruitlets and at the same time minimizing the nut breakage. If nut breakage happens, there is a great possibility that the kernel oil will be contaminated with crude oil and causing difficulty in the oil clarification stage. According to the present invention in the digestion process, nut breakage will be minimized.

Owing to uniform heat treatment, the kernel is well conditioned and has enough shrinkage, more elastic and has less tendency to break in the press.

The digester ensures the rupture of the oil cells so that during the pressing stage the oil can be easily extracted.

The digester system minimizes the unbroken oil cells to be released as the cell debris with crude oil and eventually lost in the sludge in the clarifier. Oil in the cell debris is very hard to be separated out in the clarification process.

The present invention improves the subsequent operations such as pressing, nut plant operations and oil clarification process.

I claim:

1. In a process for producing palm oil or vegetable edible oil from fresh fruit bunches, in which said fresh fruit bunches are sterilized, the sterilized fruit bunches are thereafter subjected to a stripping operation to produce stripped fruitlets, the stripped fruitlets are steam treated in a digester to be broken down into pericarps and nuts, palm oil or vegetable edible oil is extracted from the fibrous portion and the nuts are separated from remaining fibrous material, the improvement wherein said process is made continuous by the steps of:

a. continuously introducing said fresh fruit bunches in a receiving bin, b. while said fresh fruit bunches are in said receiving bin, steaming said fruit bunches with steam to deactivate any enzyme responsible for the formation of free fatty acid in said fruit bunches;

c. continuously removing fruit bunches treated as in step b. and continuously subjecting same to a combined sterilizing and stripping operation to detach fruitlets from said fruit bunches, d. continuously feeding said fruitlets, each consisting of a nut surrounded by a pericarp, to a steam pressurized digester where free virgin oil released is drained to be recovered separately, e. continuously blowing the digested pericarps and nuts from the pressurized digester to an atmospheric blow tank wherein as a result of depressurization and defibration taking place during said blowing, oil cells in the pericarps will be broken down, and f. continuously extracting oil by passing through two stage presses, the low pressure press followed by high pressure press of the said digested pericarps and nuts.

2. A process according to claim 1, wherein deactivation of the enzymes is carried out by heating said fruit bunches at a temperature of at least 55° C.

3. A process according to claim 2, wherein heating of the fruit bunches is carried out by introducing steam in said receiving bin to constitute a pre-steaming of said fruit bunches, said pre-steaming lasting about 5 to about 60 minutes and maintaining the temperature in said receiving being at between about 60° C. to 100° C.

4. A process according to claim 1, wherein after sterilizing and stripping in step c. the fruitlets are continuously conveyed to a surge bin before being received by said digester, said surge bin providing a retention time so as to control and regulate the flow of said fruitlets to said pressurized digester.

5. A process according to claim 1, wherein the sterilizing and stripping operation is carried out in a combined sterilizer stripper in which steam is continuously admitted, the sterilization and stripping operation lasts between about 20 and about 150 minutes and the temperature is maintained at between about 60° C. and about 150° C.

6. A process according to claim 1, wherein treatment in said pressurized digester lasts about 20 to about 50 minutes and the temperature is maintained in a range between about 90° C. and about 150° C.

7. A process according to claim 1, which comprises feeding fresh fruit bunches from said receiving bin to a loose fruit separator to separate loose fruitlets detached from the fruit bunches while the latter are transferred to the sterilizer/stripper, bypassing said loose fruitlets detached from said fruit bunches, while said loose fruitlets are being bypassed, subjecting same to a prewash and mild steam treatment lasting between 5 and 60 mins and is carried out at 60° C. to 100° C. effective to merely soften and sterilize said fruitlets and render them easy to digest, and directly transferring said steam treated fruitlets to said surge bin.

8. A process according to claim 1, which comprises transferring empty fruit bunches remaining from the sterilizing and stripping operation to a beater, further stripping therein any fruit remaining attached to the empty fruit bunches, conveying the stripped fruits obtained in said beater to said surge bin, and disposing of the substantially empty fruit bunches.

9. A process according to claim 1, which recovering heat evolved in said blow tank.

10. A process according to claim 3, which comprises presteaming said fruit bunches with saturated steam at about 60° C. to 100° C. for a period of 5 to 60 mins.

11. A process according to claim 7, wherein the treatment with mild steam lasts 5 to 60 minutes and causes temperature to be maintained between 60° C. and 100° C.

12. A process according to claim 1, which comprises combining the oil extracted in step f. from the low pressure press with the oil removed in step d., from the digester drains.

13. A process according to claim 12, which comprises feeding the digested pericarps and nuts obtained in said blow tank to a first press operating under low pressure to give a first crude oil containing a lesser amount of non-oil solids, feeding the pressed pericarps and nuts discharged from the first press to a second press operating at higher pressure to give a second crude oil containing a higher amount of non-oil solids, and combining and screening the crude oil drained from the digester with the second crude oil extracted from said second presses and clarifying combined oil in a first clarifier screening the first crude oil extracted from the first press and clarifying same in a second clarifier, and combining oils produced in said first and second clarifiers.

14. An integrated process for producing palm oil vegetable edible oil from fresh fruit bunches, in which said fresh fruit bunches are sterilized, the sterilized fruit bunches are thereafter subjected to a stripping operation to produce stripped fruitlets, the stripped fruitlets are steam treated in a digester to be broken down into a fibrous portion and nuts, palm oil vegetable edible oil is extracted from the fibrous portion and the nuts are separated from . remaining fibrous material, the improvement wherein said process is made continuous by the steps of:

a. continuously introducing said fresh fruit bunches in a receiving bin;

b. while said fresh fruit bunches are in said receiving bin, treating said fruit bunches to deactivate any enzyme responsible for the formation of free fatty acid in said fruit bunches by introducing a saturated steam in said receiving bin so as to constitute a presteaming of said fruit bunches, said presteaming lasting about 5 to about 60 minutes and maintaining the temperature in said receiving bin at between about 60° C. to 100° C;

c. separating loose fruitlets detached from the fruit bunches in the loose fruit separator after the said receiving bin, bypassing said loose fruitlets detached from said fruit bunches, while said loose fruitlets are being bypassed, subjecting same to prewash and a mild steam treatment lasting between 5 to 60 mins and is carried out at 60° C. to 100° C. in order to soften said fruitlets and render them easy to digest, and directly transferring said steam treated fruitlets to a surge bin;

d. continuously removing fruit bunches treated as in step b. after loose fruit separation and continuously subjecting same to a combined sterilizing and stripping operation to detach fruitlets from said fruit bunches, said sterilizing and stripping operation being carried out in a combined sterilizer stripper in which steam is continuously admitted, the sterilizing and stripping operation lasting between about 30 and about 150 minutes and the temperature being maintained at between about 60° C. and about 150° C.;

e. thereafter continuously conveying the fruitlets to said surge bin previously to continuously forwarding fruitlets present therein to a pressurized digester, said surge bin providing a retention time so as to control and regulate the flow of said fruitlets to said digester;

f. simultaneously continuously transferring empty fruit bunches remaining from the sterilizing and stripping operation to a beater, further stripping therein any fruit remaining attached to the empty fruit bunches, conveying the stripped fruits obtained in said beater to said surge bin, and disposing of the substantially empty fruit bunches;

g. continuously feeding said fruitlets, each consisting of a nut surrounded by a pericarp to said steam pressurized digester, allowing said fruitlets to remain therein for about 20 to 50 minutes while maintaining the temperature in said digester in a range between about 90° C. and about 150° C., and removing free virgin oil released;

h. continuously blowing the digested pericarps and nuts under pressure to a blow tank, to cause oil cell rupture in the digested pericarps and facilitate further extraction of palm oil or vegetable oil present therein;

i. continuously feeding the digested pericarps and nuts obtained in said blow tank to a first press operating under low pressure to give a first crude oil containing a lesser amount of non-oil solids, feeding the pressed pericarps and nuts discharged from the first press to a second press operating at a higher pressure to give a second crude oil containing a higher amount of non-oil solids; and j. combining and screening the crude oil released from the digester with the crude oil extracted from said second presses to give said palm oil or vegetable edible oil.

* * * * *

UNITED STATES PATENT AND TRADEMARK OFFICE

CERTIFICATE OF CORRECTION

PATENT NO. : 5,039,455

DATED : Aug. 13, 1991

INVENTOR(S) : Boon-Lam Kooi

It is certified that error appears in the above-identified patent and that said Letters Patent is hereby corrected as shown below:

Column 4, line 35, after "the sterilization vessel", insert --may be a single door entry or a double door with separate--.

Column 7, line 62, after "treating the fruit bunches", insert --with steam to deactivate any enzyme--.

Column 11, line 54, after "detached from the", insert --bunches. All these occurrences are not possible using the--.

Column 14, line 6, after "palm oil", insert --or--.

Column 14, line 12, after "palm oil", insert --or--.

Signed and Sealed this

Seventeenth Day of December, 1991

*Attest:*

HARRY F. MANBECK, JR.

*Attesting Officer*

*Commissioner of Patents and Trademarks*